US005660555A

United States Patent [19]

Ito et al.

[11] Patent Number: 5,660,555

[45] Date of Patent: Aug. 26, 1997

[54] WATERPROOF CONNECTOR AND METHOD FOR ASSEMBLING THE SAME

[75] Inventors: Osamu Ito; Osamu Taniuchi, both of Yokkaichi, Japan

[73] Assignee: Sumitomo Wiring Systems, Ltd., Yokkaichi, Japan

[21] Appl. No.: 563,530

[22] Filed: Nov. 6, 1995

[30] Foreign Application Priority Data

Nov. 7, 1994 [JP] Japan ..... 6-298933

[51] Int. Cl.[6] ..... H01R 13/52

[52] U.S. Cl. ..... 439/278; 439/281

[58] Field of Search ..... 439/278, 279, 439/281, 271, 374, 677, 272, 282

[56] References Cited

U.S. PATENT DOCUMENTS

| | | | |
|---|---|---|---|
| 3,594,696 | 7/1971 | Witek, Jr. | 439/278 |
| 3,953,099 | 4/1976 | Wilson | 439/279 |
| 4,193,655 | 3/1980 | Herrmann, Jr. | 439/279 |
| 4,284,312 | 8/1981 | Patchett et al. | 439/677 |
| 4,335,932 | 6/1982 | Herrmann, Jr. . | |
| 4,588,242 | 5/1986 | McDowell et al. | 439/271 |
| 4,621,883 | 11/1986 | Noguchi | 439/278 |
| 4,707,045 | 11/1987 | Ney et al. . | |
| 4,758,182 | 7/1988 | Anbo et al. | 439/271 |
| 4,842,544 | 6/1989 | Birch et al. | 439/374 |
| 4,950,175 | 8/1990 | Plyler et al. . | |
| 5,197,898 | 3/1993 | Nagamine . | |
| 5,376,013 | 12/1994 | Sawada | 439/271 |
| 5,435,738 | 7/1995 | Isohata | 439/271 |

FOREIGN PATENT DOCUMENTS

| | | |
|---|---|---|
| 0 549 370 | 6/1993 | European Pat. Off. . |
| WO-A-89 04072 | 5/1989 | WIPO . |

*Primary Examiner*—David L. Pirlot
*Assistant Examiner*—Tho D. Ta
*Attorney, Agent, or Firm*—Oliff & Berridge

[57] ABSTRACT

A waterproof connector includes elastic material, seal portion formed on a female connector housing by double molding in such a manner that the seal portion closes openings through which wires are guided, respectively, and covers a flange formed on an outer periphery of the female connector housing. The seal portion has a watertight surface at its front side. A male connector housing has hood portions for receiving the female connector housing. The hood portion includes a front end having an abutment surface for abutment against the watertight surface. With this construction, as the male and female connector housings engaged, metal terminals are fittingly connected together, and each abutment surface is brought into contact with an associated watertight surface, thereby sealing a gap between the two connector housings.

21 Claims, 5 Drawing Sheets

WATERPROOF CONNECTOR AND METHOD FOR ASSEMBLING THE SAME

BACKGROUND OF THE INVENTION

1. Field of the Invention

This invention relates to a waterproof connector and method for assembling. More particularly, to a waterproof connector that is molded in a double manner, using elastic resin. The double manner comprises a one-piece molding including first and second integral sections.

2. Description of Related Art

FIGS. 7 and 8 show one conventional waterproof connector comprising a male connector housing 1 and a female connector housing 2. Each housing has a plurality of metal terminal receiving chambers 3 having a tubular shape. A male metal terminal 5, which has a wire 4 connected thereto, is inserted into each terminal receiving chamber 3 of the male connector housing through one open end thereof, and a female metal terminal 6 is inserted into each terminal receiving chamber 3 of the female connector housing through one open end thereof. The male connector housing 1 has a hood portion 7 for receiving the female connector housing 2, and a ring-shaped rubber seal member 8 is mounted on the outer periphery of the female connector housing 2. The seal member 8 cooperates with an inner peripheral surface of the hood portion 7 to form a watertight seal therebetween when the female connector housing is inserted into the hood portion 7. After the male metal terminals 5 and female metal terminals 6 are inserted into the metal terminal receiving chambers 3, respectively, molten elastic resin 9 is applied to the open ends of the terminal receiving chambers 3 to form an inner molding (double molding) to close the gap.

When the male and female connector housings 1 and 2 are connected together, the rubber seal member 8 seals the gap between the male and female connector housings 1 and 2 in a waterproof manner, and the open ends of the metal terminal receiving chambers 3 are sealed by the elastic resin 9. Thus the molding uses a first molding in which a seal member is molded to the female connector housing and a second molding in which elastic resin seals the open ends of the terminal receiving chambers.

In the above conventional waterproof connector, the rubber seal member 8 is required for sealing the gap between the male and female connector housings 1 and 2 in a waterproof manner. Therefore, the number of the component parts is increased and considerable time and labor are required for mounting the conventional seal member.

SUMMARY OF THE INVENTION

The present invention has been made in view of the above problems, and an object of the invention is to provide a waterproof connector in which the number of component parts is reduced to reduce the cost, and the mounting operation is simplified.

According to a first aspect of the invention, there is provided a waterproof connector having wire openings for metal terminal receiving chambers through which wires are guided and a gap between the connector and a mating connector that is sealed in a waterproof manner. The waterproof connector comprising a molding that uses elastic material, with the wires kept in an inserted condition. The molding being a one-piece molding including first and second integral sections. The first section closing the wire openings and the second section forming a watertight surface for abutting against the mating connector in a watertight manner.

According to a second aspect of the invention, there is provided a method for assembling a waterproof connector, wherein wire openings of metal terminal receiving chambers, through which wires are guided, and a gap between the connector and a mating connector are sealed watertight in a waterproof manner. The method comprising the steps of forming a molding using elastic material, with the wires kept in an inserted condition, so that the elastic material closes the wire openings forming a watertight surface for abutting against the mating connector in a watertight manner. Engaging the connector and the mating connector.

According to a third aspect of the invention, there is provided a waterproof connector comprising a male connector housing having a plurality of male metal terminals and a hood portion. A female connector housing having a corresponding plurality of female metal terminals and wires connected to each female metal terminal, the wires protruding through an opening in the female connector housing. The female connector housing being receivable within the male connector housing to electrically connect the male metal terminals with the female metal terminals. A seal portion for sealing the openings of the wires in the female connector housing and for forming an abutment surface to create a watertight seal between the female connector housing when inserted within the male connector housing. The seal portion being a one-piece molding including first and second integral sections. The first section closing the openings and the second section forming a watertight surface for abutting against the male connector housing in a watertight manner.

According to a fourth aspect of the invention, there is provided a method for assembling a waterproof connector comprising the steps of providing a male connector housing that has a plurality of male metal terminals and a hood portion. Providing a female connector housing that has a corresponding plurality of female metal terminals and wires connected to each female metal terminal with the wires protruding through an opening in the female connector housing. Whereby, the female connector housing is receivable within the male connector housing to electrically connect the male metal terminals with the female metal terminals. Providing a seal portion that seals the openings of the wires in the female connector housing and forms an abutment surface to create a watertight seal between the female connector housing when inserted within the male connector housing. The seal portion being a one-piece molding including first and second integral sections. The first section closing the openings and the second section forming a watertight surface for abutting against the male connector housing in a watertight manner. Clamping and connecting the wires to the plurality of female metal terminals. Inserting the plurality of female metal terminals into the female connector housing. Forming the seal portion by molding with the plurality of wires held in a led-out condition. Engaging the female connector housing and the male connector housing.

In the first embodiment, the elastic material closes the openings of the metal terminal receiving chambers through which the wires are guided, respectively, and forms the watertight surface that closes the gap between the connector and the mating connector housing. Therefore, when the connector is connected to the mating connector, the watertight surface is held in sealing engagement with the mating connector to provide a waterproof fit.

In the second embodiment, the seal portion is formed by molding on the connector housing body that has metal terminal receiving chambers having a tubular shape. The seal portion closes the openings of the metal terminal receiving chambers, with the wires guided, respectively, from these openings. When the connector housing body is to be connected to the mating connector housing, the seal portion abuts against the abutment surface of the mating connector housing in a watertight manner.

As described above, in the present invention, the seal portion, which closes the openings of the metal terminal receiving chambers, is formed of the elastic material by molding, and has a watertight surface for contact with abutment surface of the mating connector. Therefore, a similar effect as achieved by the provision of a rubber seal is obtained and the number of the component parts of the waterproof connector is reduced, as well as requiring less time and labor for the mounting operation.

BRIEF DESCRIPTION OF THE DRAWINGS

Preferred embodiments of the present invention will now be described with reference to the drawings, wherein.

DETAILED DESCRIPTION OF PREFERRED EMBODIMENTS

Figure 1:
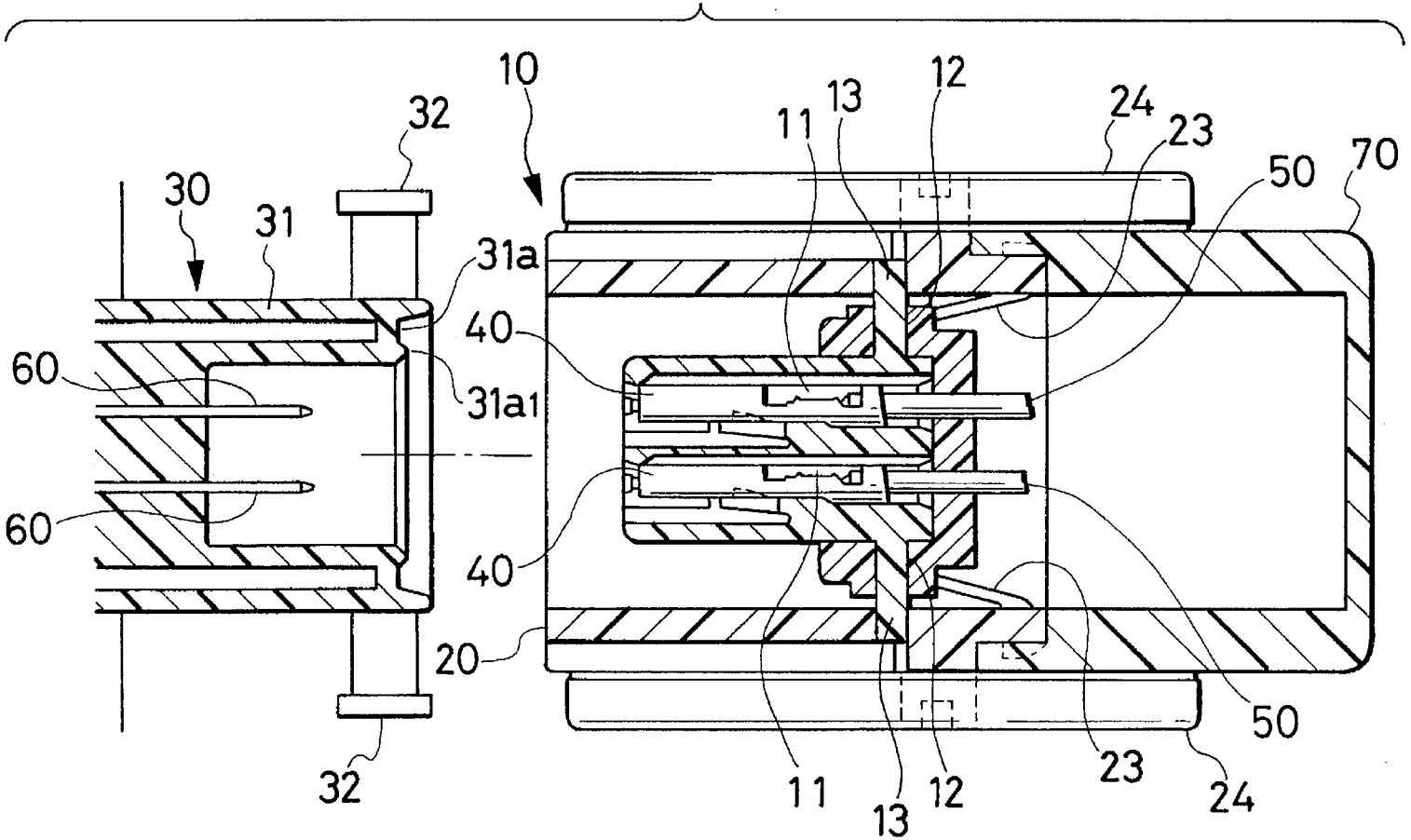
FIG. 1 is a cross-sectional view of one preferred embodiment of a waterproof connector of the present invention.
Figure 4:
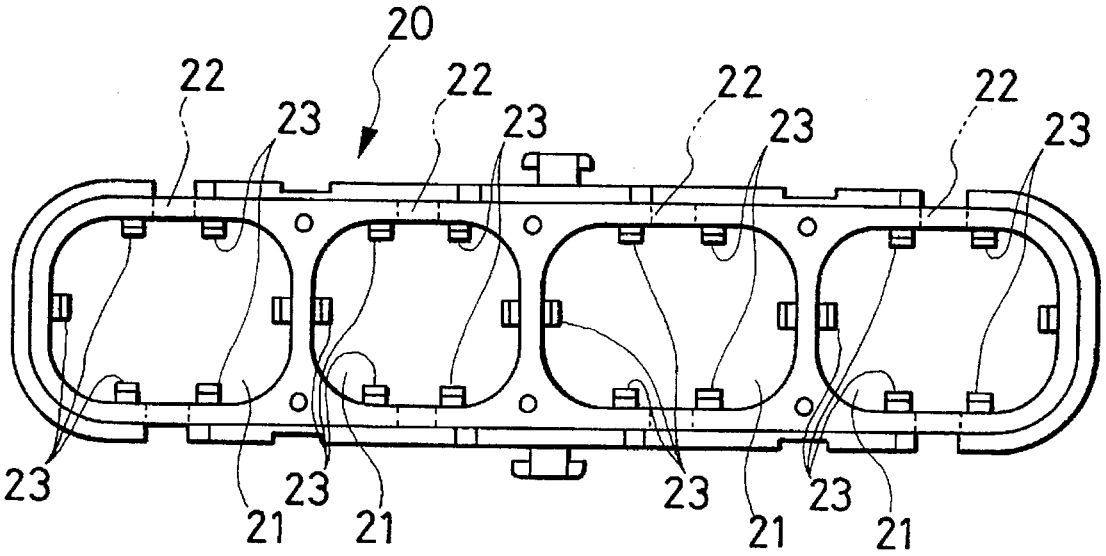
FIG. 4 is a front-elevational view of a frame.
Figure 5:
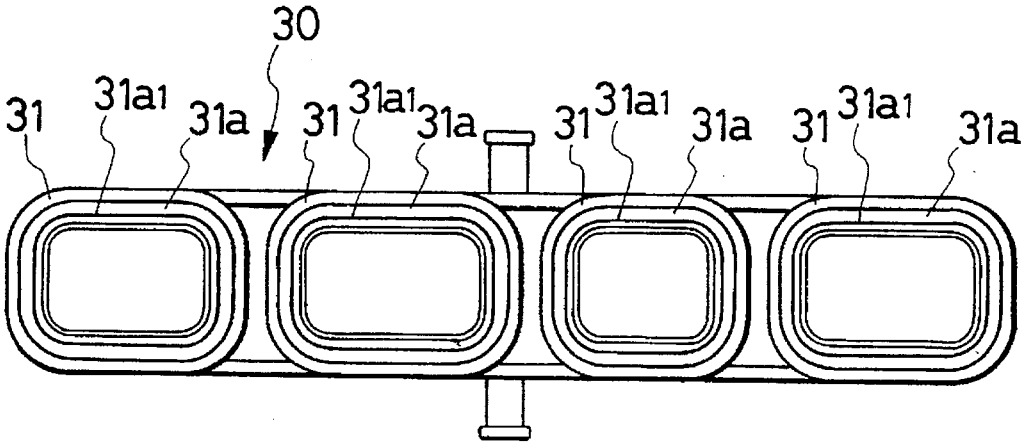
FIG. 5 is a front-elevational view of a male connector housing.
Figure 6:
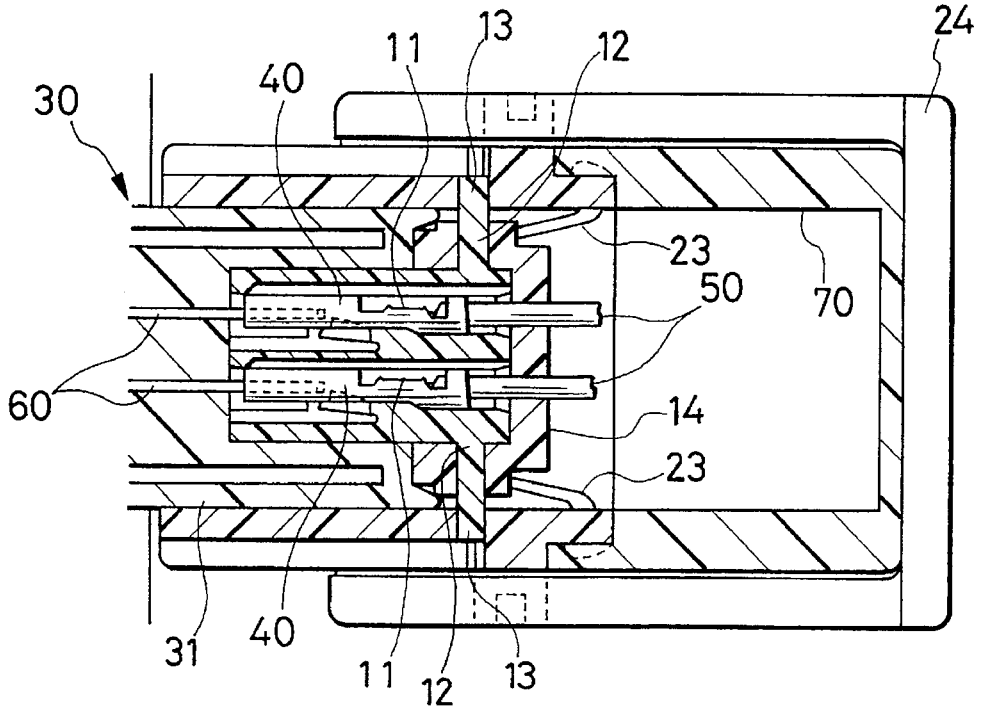
FIG. 6 is a cross-sectional view of the waterproof connector.
Figure 8:
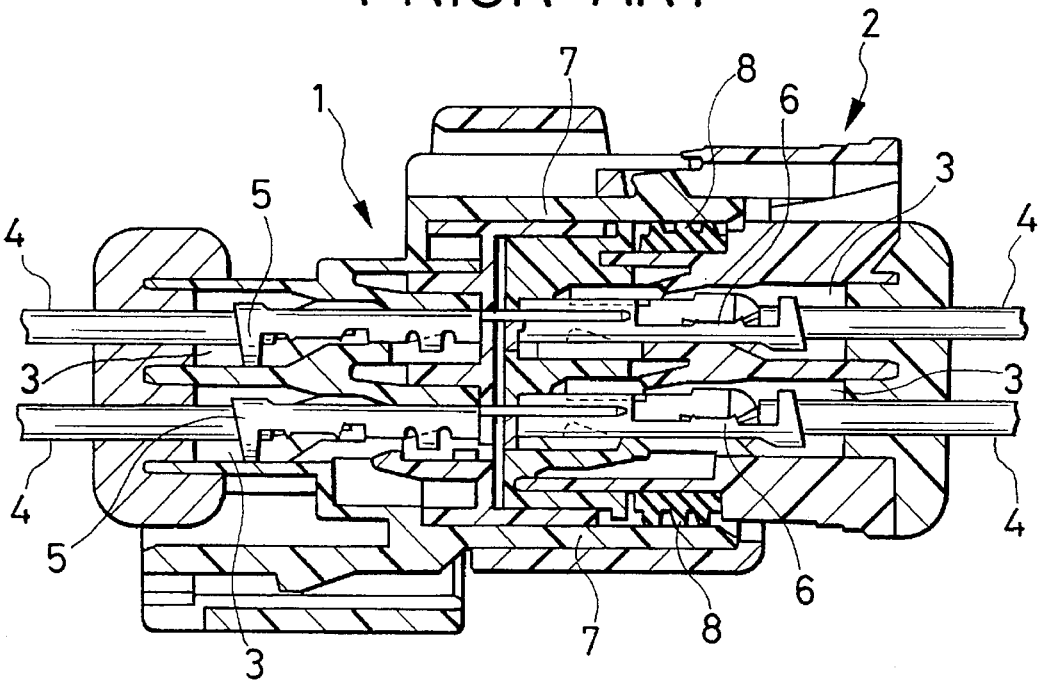
FIG. 8 PRIOR ART
FIG. 8 is a cross-sectional view of the conventional waterproof connector.
Figure 7:
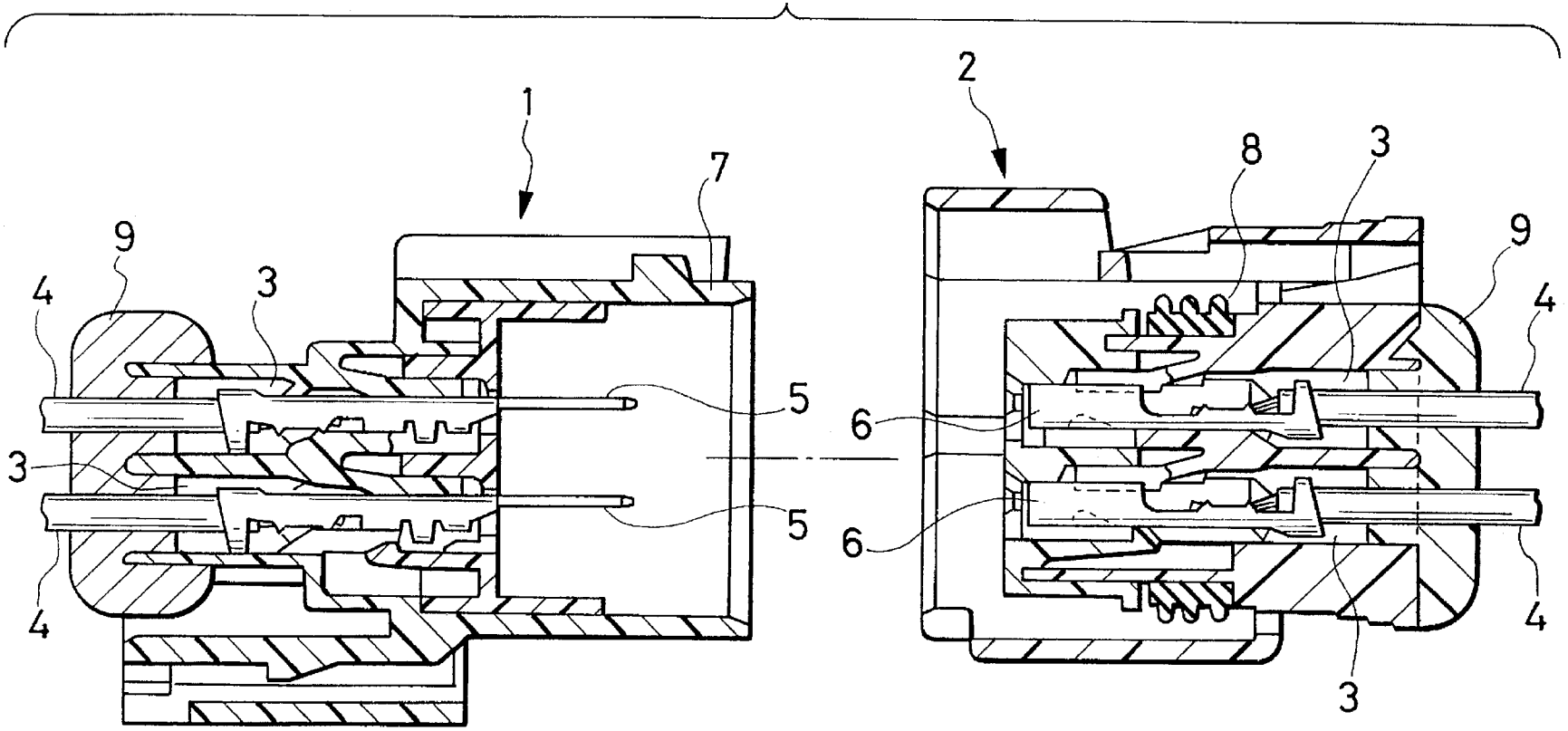
FIG. 7 PRIOR ART
FIG. 7 is a cross-sectional view of a conventional waterproof connector.

FIG. 1 is a cross-sectional view of one preferred embodiment of a waterproof connector of the invention. Four female connector housings 10 (see FIGS. 2 and 3) having a generally tubular shape are received in a juxtaposed manner and held in a frame 20 (see FIG. 4). A male connector housing 30 (see FIG. 5) having an integral construction has four convex portions that face the four female connector housings 10, held by the frame 20, respectively.

Figures 2A, 2B, 2C, 2D:
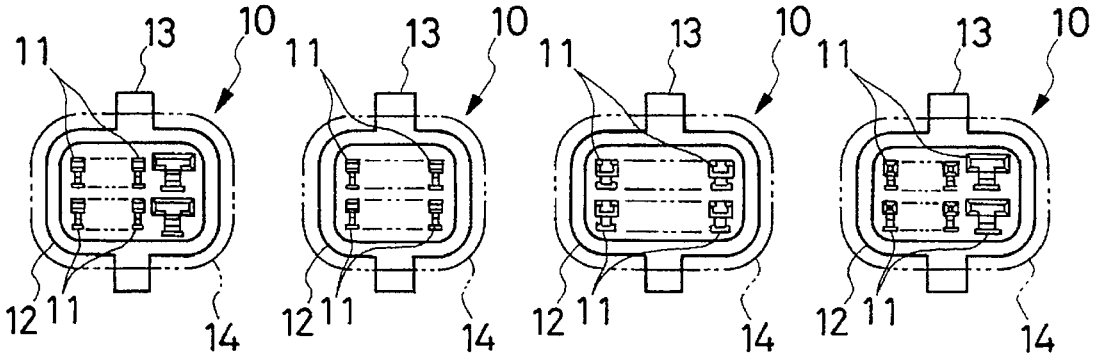
FIG. 2 is a front-elevational view showing female connector housings.
Figure 3:
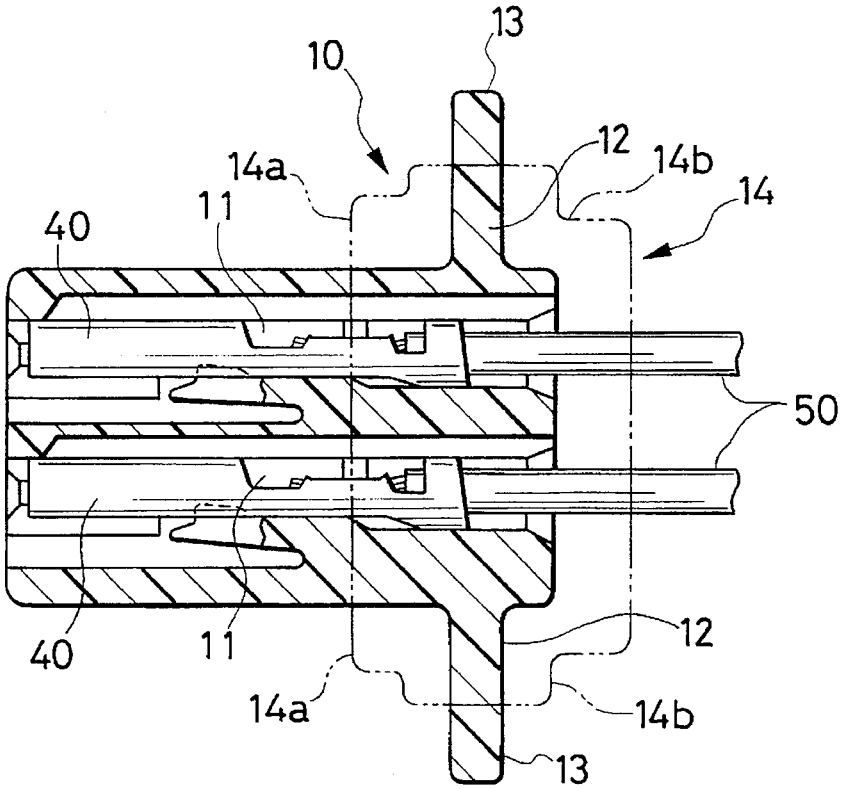
FIG. 3 is a cross-sectional view of the female connector housing.

The female connector housings 10 shown in FIGS. 2 and 3 have a tubular and generally rectangular cross-sectional shape. Two (upper and lower) rows of juxtaposed metal terminal receiving chambers 11 having a tubular shape are formed in the female connector housing 10. The metal terminal receiving chamber 11 has opposite open ends disposed respectively at the opposite ends of the female connector housing 10. When a female metal terminal 40 is inserted into the metal terminal receiving chamber 11 through the rear end thereof, the female metal terminal 40 is held in the metal terminal receiving chamber 11, with a wire 50 (connected to the female metal terminal 40) extending from the metal terminal receiving chamber 11. A flange 12 is formed on the entire outer periphery of the female connector housing 10 at the rear end portion thereof, and a positioning projection 13 is formed on a central portion of each of the upper and lower portions of the flange.

The female metal terminals 40 are attached and, in this condition, elastic resin is molded in a double manner to form a seal portion 14 on the outer periphery of the rear end portion of the female connector housing. The seal portion 14 closes the rear open ends of the metal terminal receiving chambers 11 and covers the flange 12 in a manner that also covers a front side thereof. In such a configuration, the seal portion 14 increases the outer diameter of the female connector housing 10. The front surface of the seal portion is flat and serves as a watertight surface 14*a*. In this embodiment, although elastic resin is used as the elastic material, any other suitable material such as rubber can be used in so far as it achieves a waterproof effect. In this embodiment, the seal portion can be provided around the sealed portion in a manner that also covers a fitting surface and thus the seal portion can be modified in any shape in accordance with the surface of contact of the male connector housing 30. The projections 13 project from the seal portion 14.

Housing receiving holes 21 having a tubular shape are formed in the frame 20 and correspond in shape with the associated female connector housings 10, respectively. Each housing receiving hole 21 has a pair of notches 22 formed in central portions of the upper and lower walls of the frame 20. The notches 22 are open to the rear side of the frame 20 so that each female connector housing 10 can be inserted into the associated housing receiving hole 21 from the rear side. The notch 22 is generally equal in width to the projection 13. The projections 13 of each female connector housing 10 are brought into registry with the notches 22 of the associated housing receiving hole 21, respectively. Then, the female connector housing 10 is inserted into the housing receiving hole 21, so that the female connector housing 10 can be guided to be disposed centrally in the housing receiving hole 21.

Elastic engagement pawls 23 are formed on the inner peripheral surface of the housing receiving hole 21 adjacent to the rear end of the frame 20 and project into the housing receiving hole 21. Each engagement pawl 23 projects inward of the inner peripheral surface of the housing receiving hole 21 progressively from the rear side of the frame toward the front side thereof. As the female connector housing 10 is inserted into the housing receiving hole 21, the engagement pawl 23 flexes outward of the inner peripheral surface to slidingly contact the outer periphery of the seal portion 14. When the female connector housing is inserted until the projections 13 engage the inner ends of the notches 22, respectively, the seal portion 14 passes the engagement pawls 23 so that the engagement pawls 23 are restored outward of the inner peripheral surface to engage the rear surface of the seal portion 14. A stepped portion 14*b* is formed at the rear surface of the seal portion 14 and is engagable with the engagement pawls 23. The step portion 14*b* covers the rear side of the flange 12 and causes the flange 12 to bear the load. In this embodiment, although the female connector housings 10 are adapted to be supported by the frame 20, it is not always necessary to provide separate female connector housings, and the female connector housings can be formed integrally with the frame.

Each male connector housing 30 supports male metal terminals 60 in a projected manner, the terminals being arranged to be aligned respectively with the female metal terminals 40 received in the female connector housings 10. Four hood portions 31 having a tubular shape surround the corresponding male metal terminals 60 and are formed on the male connector housing 30. Each hood portion 31 is sized to receive an associated female connector housing 10. The front end of the hood portion 31 projects only at its outer peripheral portion to provide an annular portion. The annular portion has an inner diameter that engages the outer peripheral surface of the seal portion 14. A generally flat abutment surface 31*a*, disposed inward of the annular portion, is adapted to engage the watertight surface 14*a* of the seal portion 14. An annular projection 31*a*1 is formed on the abutment surface 31*a* and extends toward the watertight surface 14*a*. In this embodiment, although the front or distal end of the hood portion 31 is adapted to abut against the seal portion 14, the seal portion may be provided at the front end portion of the female connector housing 10, in which case the seal portion 14 abuts against the inner end wall of the hood portion 31. Although the front end of the hood portion 31 projects only at its outer peripheral portion, only the abutment surface 31*a* may be provided at the front end. However, by providing such a projected outer peripheral portion, the abutment surface 31*a* is less liable to be damaged.

A pair of projections 32 is formed respectively on the upper and lower surfaces of the male connector housing 30. The projections are disposed centrally of the width of the housing. Engaging levers 24 are provided on the frame 20 and are adapted to be engaged respectively with the projections 32 so as to draw the projections. A cover 70 is attached to the rear end of the frame 20 and leads the wires 50 out in a collective manner.

An assembling method and the operation of this embodiment of the above construction will now be described.

With respect to the female connector housing 10, the wires 50 are clamped and connected to the female metal terminals 40, respectively, and the metal terminals are inserted into the metal terminal receiving chambers 11, respectively. After the female metal terminals 40 are thus inserted into all the metal terminal receiving chambers 11, respectively, the molding is formed by the use of elastic resin, with the wires 50 held in a ledout condition. The elastic resin forms a seal portion 14 that closes the rear open ends of the metal terminal receiving chambers 11 and covers the flange 12. The female connector housing 10 is inserted into the housing receiving hole 21 in the frame 20 from the rear side thereof. As the connector housing is inserted with the projections 13 received respectively in the notches 22 in the frame 20, the outer peripheral surface of the seal portion 14 is brought into engagement with the engagement pawls 23 to flex the pawls outward. When the projections 13 abut against the inner ends of the notches 22, respectively, the seal portion 14 passes the engagement pawls 23 so that the engagement pawls 23 are restored to engage the step portion 14*b* formed at the rear side of the seal portion 14. In this condition, the projections 13 are held against the inner ends of the notches 22, thereby preventing a forward movement of the female connector housing. Also, the engagement pawls 23 are engaged with the rear surface of the seal portion 14, thereby preventing a rearward movement of the female connector housing, so that the female connector housing is held in a fixed condition.

The male metal terminals 60 are attached to the male connector housing. The hood portions 31 are inserted respectively into the housing receiving holes 21 from the front side of the frame 20. During the inserting operation, the projections 32 are engaged respectively in spiral grooves formed respectively in the engagement levers 24, and the engagement levers 24 are turned to draw the projections 32 into the spiral grooves, respectively, so that the male connector housing 30 is moved toward the frame 20. As the hood portions 31 are inserted respectively into the housing receiving holes 21, the male metal terminals 60 are inserted respectively into the front open ends of the metal terminal receiving chambers 11 of the female connector housings 10. Then, male metal terminals 60 are fitted in and connected to the female metal terminals 40, respectively.

When the engagement levers 24 are fully turned, the front end of each of the hood portions 31 is held against the seal portion 14. The outer peripheral portion of the seal portion 14 is received in the annular portion formed at the front end of the hood portion 31, and the watertight surface 14*a* defined by the front surface of the seal portion 14 is held against the abutment surface 31*a* of the hood portion 31. At this time, the annular projection 31*a*1, formed on the abutment surface 31*a*, bites into the watertight surface 14*a* of the elastic resin, thus enhancing the waterproof effect.

The elastic material, such as elastic resin, is thus molded on the female connector housing 10 in a double manner to form the seal portion 14 which closes the open ends through which the wires 50 are guided. Seal portion 14 covers the flange 12, which is formed on the outer periphery of the female connector housing 10, and has a watertight surface 14*a* at its front side. The hood portions 31 for respectively receiving the female connector housings 10 are formed on the male connector housing 30. The abutment surface 31*a* is formed at the front end of each hood portion 31 so as to abut against the watertight surface 14*a*. Therefore, the two surfaces 14*a* and 31*a* are opposed to each other and are moved toward each other so that the male metal terminals are fittingly connected to the female metal terminals. Each abutment surface 31*a* abuts against the associated watertight surface 14*a*, thereby sealing the gap between the two connector housings 10 and 30 in a waterproof manner. Although the above embodiment is directed to the so-called lever-type connector having the engagement levers 24, the invention can be applied to a connector of the ordinary type.

The invention has been described with reference to preferred embodiments thereof, which are intended to be illustrative, not limiting. Various modifications will be apparent to those of ordinary skill in the art and are intended to be encompassed within the spirit and scope of the invention, as set forth in the appended claims.

What is claimed is:

1. A waterproof connector having wire openings for metal terminal chambers through which wires are guided and a gap between said connector and a mating connector that is sealed in a waterproof manner, said waterproof connector comprising a molding that uses elastic material, with said wires kept in an inserted condition, said molding being a one-piece molding including first and second integral sections, said first section closing said wire openings and said second section having a stepped portion comprising at least a pair of annular surfaces in separate planes facing in substantially a longitudinal direction of the connector, the pair of surfaces being abuttable against a leading end of said mating connector in a watertight manner, said leading end having a contour substantially corresponding to said stepped portion.

2. The waterproof connector according to claim 1, further comprising:

a connector housing body that has metal terminal receiving chambers having a tubular shape and an abutment surface which faces a mating connector housing when said connector housing body is fittingly connected to the mating connector housing.

3. A method for assembling a waterproof connector, wherein wire openings of metal terminal receiving chambers, through which wires are guided, and a gap between said connector and a mating connector are sealed watertight in a waterproof manner, said method comprising the steps of:

forming a molding using elastic material, with said wires kept in an inserted condition, so that said elastic material closes said wire openings and so that the molding has a stepped portion comprising at least a pair of annular surfaces in separate planes facing in a substantially longitudinal direction of the connector, the pair of surfaces being abuttable against a leading end of said mating connector in a waterproof manner, the leading end having a contour substantially corresponding to said stepped portion; and engaging the connector and the mating connector.

4. The method according to claim 3, further comprising the steps of:

providing a connector housing body which has metal terminal receiving chambers of a tubular shape and abutment surface that faces a mating connector housing when said connector housing body is to be fittingly connected to the mating connector housing; and forming a front sealing side on a front side of said abutment surface with said second section for abutting against an abutment surface of said mating connector housing in a watertight manner.

5. A waterproof connector comprising:

a male connector housing having a plurality of male metal terminals, a leading end and a hood portion;

a female connector housing having a corresponding plurality of female metal terminals and wires connected to each female metal terminal, said wires protruding through an opening in said female connector housing, the female connector housing being receivable within the male connector housing to electrically connect the male metal terminals with the female metal terminals; and a seal portion for sealing the openings of the wires in the female connector housing and for forming an abutment surface to create a watertight seal between the female connector housing when inserted within the male connector housing, the seal portion being a one-piece molding including first and second integral sections, said first section closing said openings and said second section having a stepped portion comprising at least a pair of annular surfaces in separate planes facing in substantially a longitudinal direction of the connector, the pair of surfaces being abuttable against a leading end of said mating connector in a watertight manner, the leading end having a contour substantially corresponding to said stepped portion.

6. The connector according to claim 5, wherein said female connector housing has a tubular shape and a generally rectangular cross-sectional shape.

7. The connector according to claim 5, wherein said female connector housing has an upper row and a lower row of a plurality of female metal terminal receiving chambers having a tubular shape, said plurality of female metal terminals being insertable within said plurality of female metal terminal receiving chambers; and said male connector housing having a corresponding plurality of male metal terminal receiving chambers, said plurality of male metal terminals being insertable within said plurality of male metal terminal receiving chambers.

8. The connector according to claim 7, wherein said female connector housing has a flange formed on an outer periphery of said female connector housing, said flange having upper and lower portions, each of said upper and lower portions having a guiding projection formed on a central portion of each of said upper and lower portions for interengaging with a corresponding receiving notch in the female connector housing.

9. The connector according to claim 8, wherein said second section of said seal portion is molded around said flange, said second section forming a stepped portion on a rear side of said flange and a flat portion on a front side of said flange, said positioning projections projecting from said second section.

10. The connector according to claim 9, further comprising:

a plurality of said female connector housings having a generally tubular shape, said plurality of female connector housings being disposed and held in a frame; and a corresponding plurality of said male connector housings forming an integral structure.

11. The connector according to claim 10, wherein said frame has a plurality of housing receiving holes of a tubular shape formed therein, each of said plurality of housing receiving holes has a pair of notches formed in an upper wall and a lower wall of said frame;

each of said pair of notches being open to a rear side of said frame allowing said plurality of female connector housings to be insertable into a corresponding one of said plurality of housing receiving holes; and each of said pair of notches being generally equal in width to said positioning projection allowing said plurality of female connector housings to be centrally disposed in said plurality of housing receiving holes.

12. The connector of claim 11, wherein each of said plurality of housing receiving holes has a plurality of engagement pawls formed on an inner peripheral surface of each of said plurality of housing receiving holes; and each of said plurality of engagement pawls being adjacent to said rear side of said frame and projecting inwardly of said inner peripheral surface for engaging said stepped portion of second section.

13. The connector according to claim 12, wherein said hood portion of each of said plurality of male connector housings has a tubular shape and an inner diameter allowing insertion of said female connector housings;

said hood portion having a flat abutment surface for engaging said flat portion of said second section; and said flat abutment surface having an annular projection projecting outwardly.

14. The connector according to claim 13, wherein said integral structure has a pair of projections formed on an upper and lower structure surface of said integral structure, said pair of projections being disposed centrally of a width of said integral structure; and said frame having a pair of engaging levers, said pair of engaging levers being adapted to engage said pair of projections.

15. The connector according to claim 14, wherein said frame has a cover attached to said rear side.

16. A method for assembling a waterproof connector comprising the steps of:

providing a male connector housing with a front surface that has a plurality of male metal terminals and a hood portion;

providing a female connector housing that has a corresponding plurality of female metal terminals and wires connected to each female metal terminal with said wires protruding through an opening in said female connector housing, whereby the female connector housing is receivable within the male connector housing to electrically connect the male metal terminals with the female metal terminals;

providing a flange on an outer periphery of said female connector housing with an upper portion and a lower portion, said upper portion and said lower portion each having a centrally formed guiding projection for interengaging with a corresponding receiving notch in the female connector housing;

forming a flat portion of a front side of said flange and a stepped portion on a rear side of said flange;

providing a seal portion that seals the openings of the wires in the female connector housing and forms an abutment surface to create a watertight seal between the female connector housing and said front surface when inserted within the male connector housing, the seal portion being a one-piece molding including first and second integral sections, said first section closing said openings and said second section forming a watertight surface which abuts against the male connector housing in a watertight manner;

molding said second section around said flange such that said guiding projections extend past said second section;

clamping and connecting said wires to said plurality of female metal terminals;

inserting said plurality of female metal terminals into a said female connector housing;

forming said seal portion by molding with said plurality of wires held in a led-out condition; and engaging said female connector housing and said male connector housing.

17. The method according to claim 16, further comprising the steps of:

providing a plurality of female connector housings that are held in a frame, the frame has a corresponding plurality of housing receiving holes, wherein said plurality of female connector housings are inserted through a rear side of said frame, and a corresponding plurality of pairs of notches, wherein said plurality of positioning projections are received; and providing a corresponding plurality of male connector housings that form an integral structure.

18. The method of claim 17, further comprising the step of providing a flat abutment surface, with an annular projection projecting outwardly, on said hood portion for engaging said flat portion of said second section.

19. The method according to claim 18, further comprising the steps of:

providing a pair of projections formed on an upper surface and a lower surface of said integral structure that are disposed centrally of a width of said integral structure; and providing a corresponding pair of engaging levers on an upper surface and a lower surface of said frame that are engagable with pair of projections.

20. The method according to claim 19, further comprising the step of providing a plurality of engagement pawl slanting inward within each of said plurality of housing receiving holes on an inner surface thereof so that each of said plurality of engagement pawls slidingly contacts an outer peripheral surface of said seal portion when said plurality of female connector housings are inserted into said frame, thereby causing each engagement pawl to flex outward until said engagement pawl supporting engage said stepped portion.

21. The method according to claim 20, further comprising the step of providing a cover on said frame attached to said rear side for collectively leading said wires away from the frame.

* * * * *